US007364463B1

(12) United States Patent
Ju

(10) Patent No.: US 7,364,463 B1
(45) Date of Patent: Apr. 29, 2008

(54) STACKED CONNECTOR ASSEMBLY

(75) Inventor: Ted Ju, Keelung (TW)

(73) Assignee: Lotes Co., Ltd. (TW)

( * ) Notice: Subject to any disclaimer, the term of this patent is extended or adjusted under 35 U.S.C. 154(b) by 0 days.

(21) Appl. No.: 11/363,036

(22) Filed: Feb. 28, 2006

(51) Int. Cl.
*H01R 13/648* (2006.01)

(52) U.S. Cl. ..... 439/607; 439/541.5

(58) Field of Classification Search ..... 439/607, 439/541.5

See application file for complete search history.

(56) References Cited

U.S. PATENT DOCUMENTS 6,113,428 A * 9/2000 Yeh ..... 439/609
6,139,367 A * 10/2000 Yeh ..... 439/609
6,238,241 B1 * 5/2001 Zhu et al. ..... 439/541.5
6,540,563 B1 * 4/2003 Hu et al. ..... 439/676
2004/0180577 A1 * 9/2004 Zhang ..... 439/607
2006/0014431 A1 * 1/2006 Shuey et al. ..... 439/607

* cited by examiner

*Primary Examiner*—Tho D. Ta
(74) *Attorney, Agent, or Firm*—Troxell Law Office, PLLC

(57) ABSTRACT

The present invention discloses a connector comprising an insulating base body having a base portion, and the base portion further includes a plurality of layers of containing space; an external casing installed on an external side of the insulating base body; a first connector contained in the containing space and having a plurality of first terminals installed in a first internal casing; and at least one second connector contained in the containing space and having a plurality of second terminals installed in a second internal casing, and both sidewalls of the connector further includes a contact portion for electrically connecting the external casing, so that the contact portion of the second internal casing is electrically connected with the external casing to eliminate electrostatic charges.

17 Claims, 6 Drawing Sheets

STACKED CONNECTOR ASSEMBLY

BACKGROUND OF THE INVENTION

1. Field of the Invention

The present invention relates to a connector, and more particularly to a connector capable of eliminating electrostatic charges effectively.

2. Description of the Related Art

In general, present existing connectors include a plurality of terminals extended backward and bent downward from the connector for electrically connecting a circuit board. The connectors also include an internal casing wrapped completely by an insulating base body, and the internal casing is not electrically connected to an external casing, and thus it is difficult to eliminate electrostatic charges in the connectors.

SUMMARY OF THE INVENTION

Therefore, it is a primary objective of the present invention to provide a connector capable of eliminating electrostatic charges effectively.

To achieve the foregoing objective, the present invention comprises an insulating base body having a base portion, and the base portion further includes a plurality of layers of containing space; an external casing installed on an external side of the insulating base body; a first connector contained in the containing space and having a plurality of first terminals installed in a first internal casing; and at least one second connector contained in the containing space and having a plurality of second terminals installed in a second internal casing, and each of both sidewalls of the connector further includes a contact portion for electrically connecting the external casing, so that the contact portion of the second internal casing is electrically connected with the external casing for eliminating electrostatic charges.

Compared with the existing technology, the connector of the present invention has a contact portion protruded from the internal casing and electrically connected to the external casing for eliminating electrostatic charges in the connector effectively.

To make it easier for our examiner to understand the objective of the invention, its structure, innovative features, and performance, we use a preferred embodiment together with the attached drawings for the detailed description of the invention.

DETAILED DESCRIPTION OF THE PREFERRED EMBODIMENTS

Figure 1:
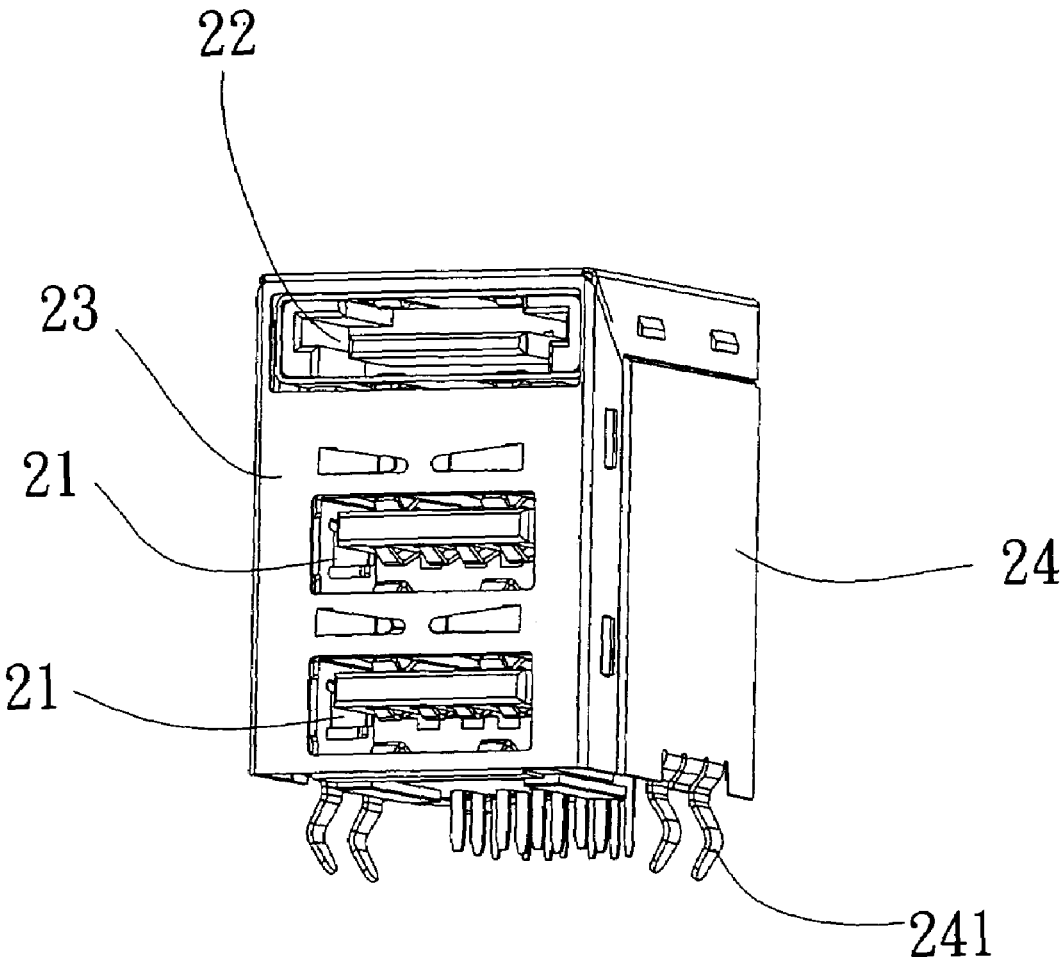
FIG. 1 is a perspective view of a connector according to a preferred embodiment of the present invention.
Figure 2:
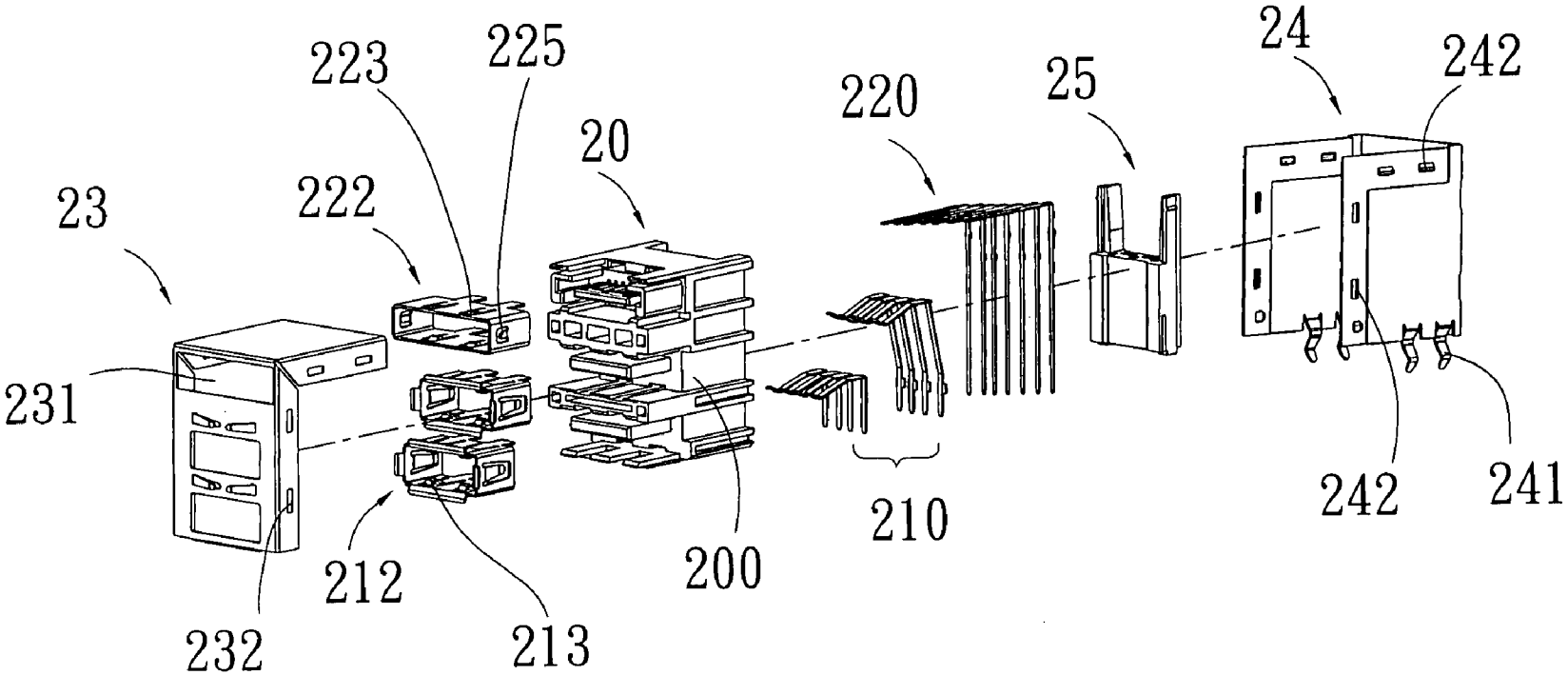
FIG. 2 is an exploded view of a connector according to a preferred embodiment of the present invention.
Figure 3:
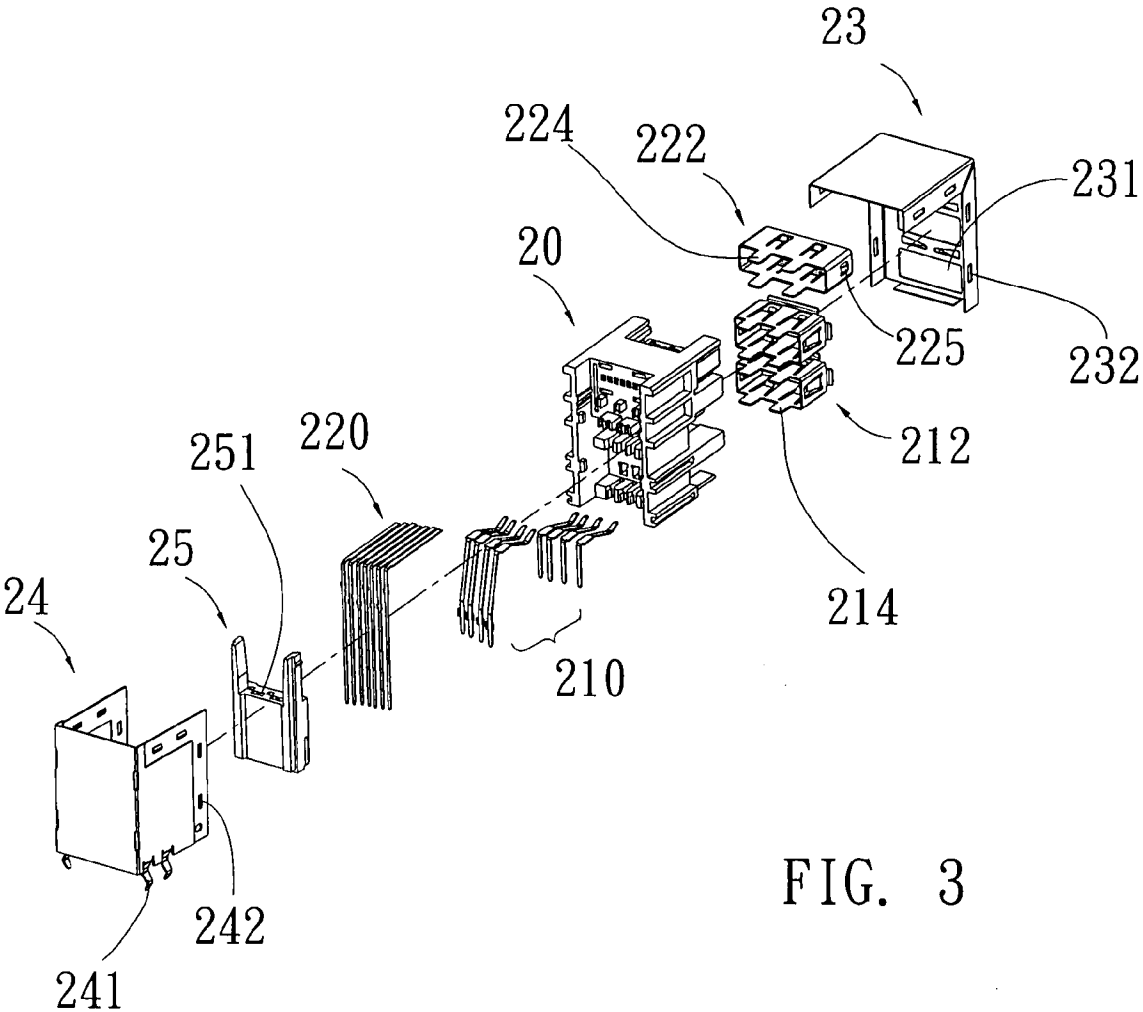
FIG. 3 is a schematic view of a connector according to a preferred embodiment of the present invention.
Figure 4:
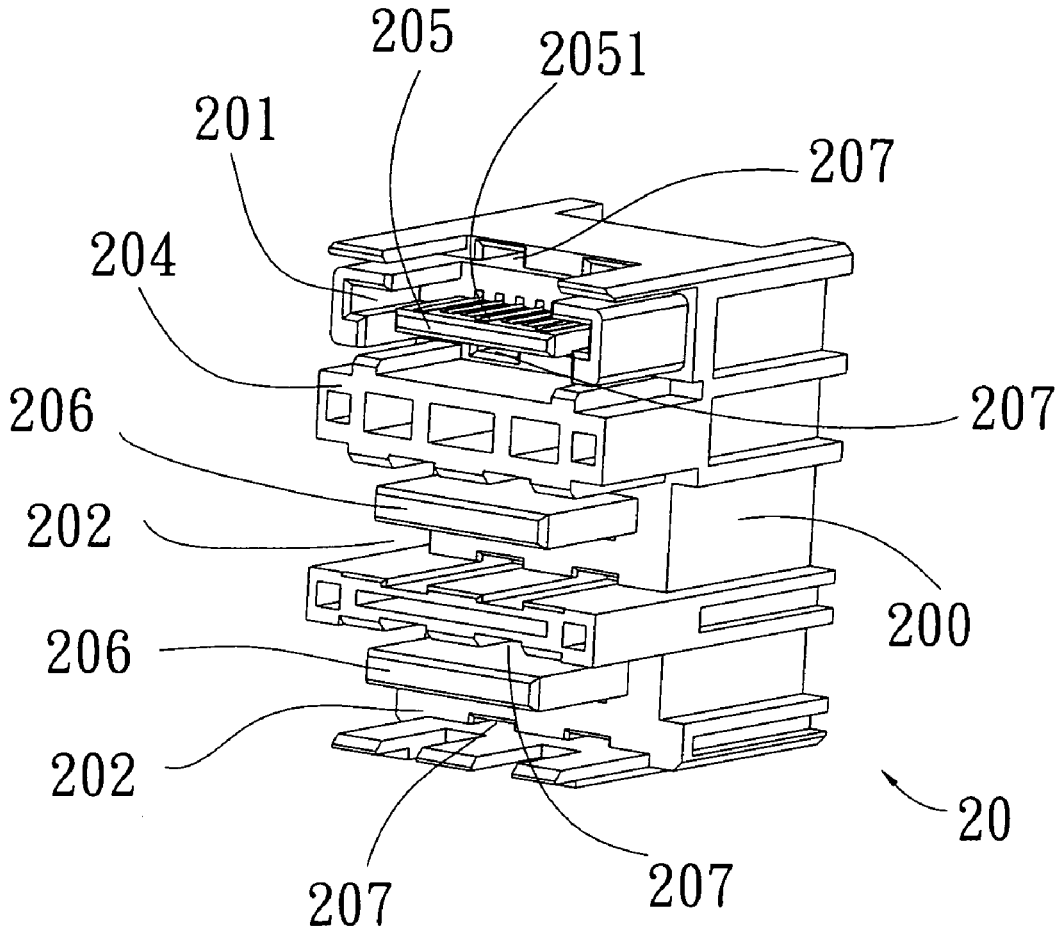
FIG. 4 is a perspective view of an insulating body of a connector as depicted in FIG. 1.
Figure 5:
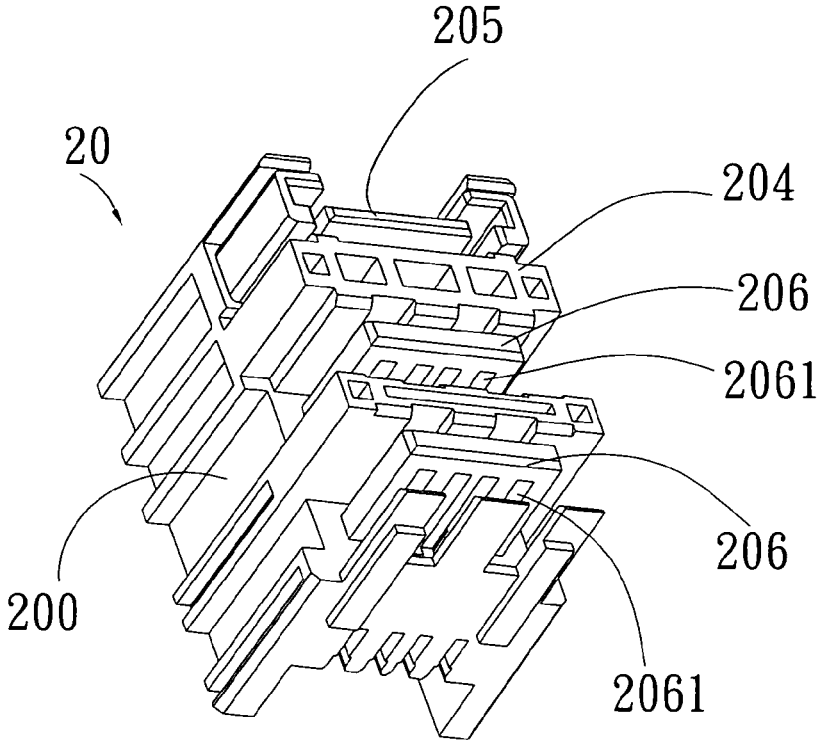
FIG. 5 is another perspective view of an insulating body of a connector as depicted in FIG. 4.
Figure 6:
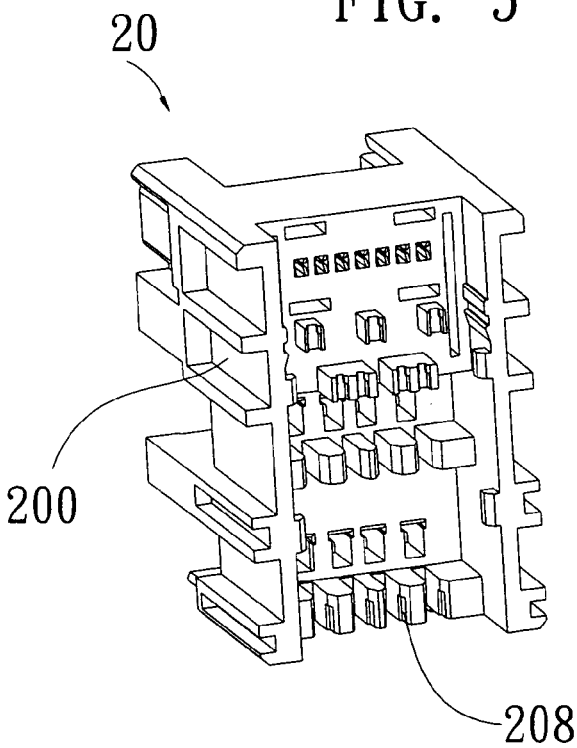
FIG. 6 is a further perspective view of an insulating body of a connector as depicted in FIG. 4.

Referring to FIGS. 1 to 6, a connector of the invention is installed on a circuit board (not shown in the figures) for connecting a plurality of other connectors and comprises an insulating base body 20, a first connector 21, at least one second connector 22, and an external casing.

The first connector 21 contains a first terminal 210, and the second connector 22 contains a second terminal 220, and the external casing is installed on the exterior of the insulating base body 20. The first connector 21 includes but not limited to a USB interface (not shown in the figure), and there are two first connectors 21 in this preferred embodiment, and the second connector 22 includes but not limited to a SATA interface (not shown in the figures), and the second connector 22 is situated on the top of the first connector 21.

The insulating base body 20 is shared by the first and second connectors 21, 22 and it is an integral structure comprising a base portion 200, and the front end of the base portion 200 further includes three layers of containing spaces which are a first containing space 201 for containing the first connector 21 and a second containing space 202 for containing the second connector 22, and the first containing space 201 has two layers, and the second containing space 202 has one layer, and the second containing space 202 is situated on the top of the first containing space 201. A partition 204 is installed between two adjacent layers of the containing spaces 201, 202, while each containing space 201, 202 includes a first tongue portion 205 and a second tongue portion 206 respectively, and the first tongue portion 205 includes a first terminal containing groove 2051 for containing a first terminal 210, and the second tongue portion 206 includes a second terminal containing groove 2061 for containing the second terminal 220. Further, the base of each tongue portion 205, 206 includes a fixing hole 207, and the rear end of the base includes a fixing portion 208 for fixing the first terminal 210 (which is a USB terminal in this embodiment).

Two first connectors 21 include a first internal casing 212 of the same architecture, and the external side of the first internal casing 212 has a flared opening, a first bracket 213 separately at the top and the bottom of the first internal casing 212 for securely connecting the connector with a USB interface (not shown in the figures) to the first connector 21, and the internal side of the first internal casing 212 includes a first fixing plate 214 to be fixed in the fixing hole 207 on the insulating base body 20.

The second connector 22 also includes a second internal casing 222, and a second bracket 223 disposed separately at the bottom and the top of the second internal casing 222. The two brackets 223 can securely connect the connector with the SATA interface (not shown in the figures) to the second connector 22, and the internal side of the second internal casing 212 includes a second fixing plate 224 to be fixed into the fixing hole 207 on the insulating base body 20. Further, the second internal casing 222 further includes a contact portion 225 protruded separately from both sidewalls of the second internal casing 222 for electrically connecting the external casing, and the contact portion 225 could be an outwardly protruded bracket.

The external casing includes a front casing 23 and a rear casing 24, and the front casing 223 has a plurality of openings 231 disposed at its front end and a plurality of square openings 232 disposed on both sides. The rear casing 24 includes a plurality of grounding pins 241 disposed at its bottom and a plurality of protrusions 242 disposed on its lateral sides, such that when the front casing 23 and the rear casing 24 are engaged with each other, the protrusions 242 are latched into the square openings 232, and thus the front and rear casings can effectively protect the insulating base body 20. The contact portion 225 can be electrically connected with the rear casing 24 for eliminating electrostatic charges from the rear casing 24 through the grounding pin 241.

The connector further includes a rear base 25 for fixing the second terminal 220 (which is a SATA terminal in this embodiment), and the rear base 25 further includes a plurality of holes 251 for fixing the second terminal 220 therein. The rear base 25 is fixed between two sidewalls of the base portion 220 of the insulating base body 20.

Figure 7:
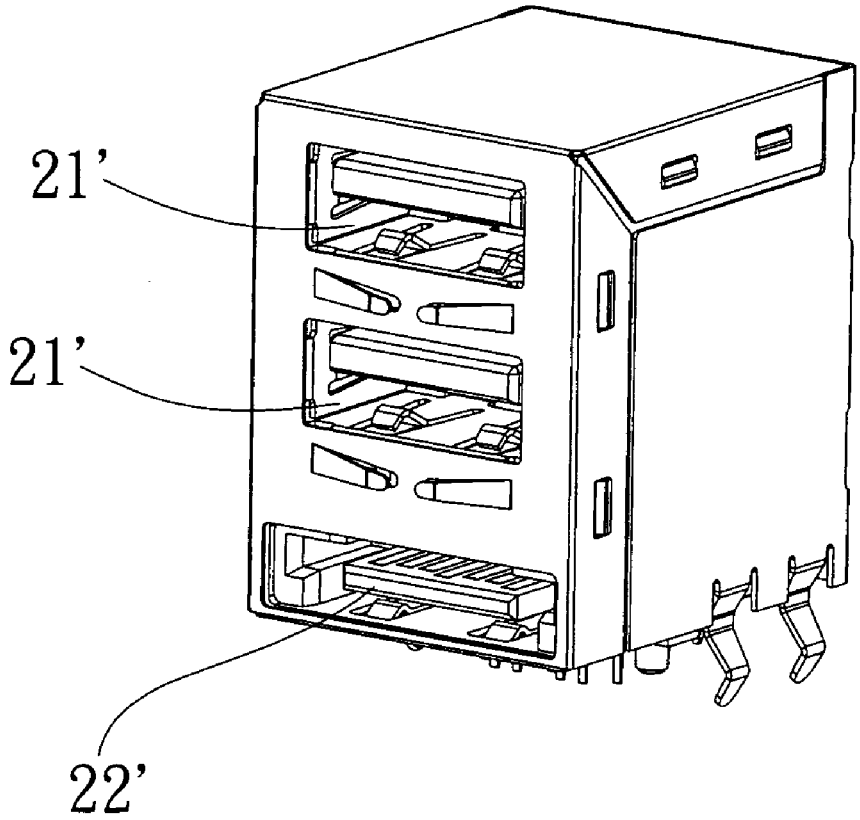
FIG. 7 is a schematic view of a connector according to another preferred embodiment of the present invention.

Referring to FIG. 7 for the schematic view of a connector according to another preferred embodiment of the present invention, the difference of this connector with the previous preferred embodiment resides on that this embodiment includes at least one first connector 21' and a second connector 22', and the first connector 21' is situated on the top of the second connector 22', and this preferred embodiment also can achieve the aforementioned objectives. The first connector 21' includes but not limited to a USB interface (not shown in the figures), and there are two USB interfaces in this preferred embodiment, and the second connector 22 includes but not limited to a SATA interface (not shown in the figures).

With the implementation of the connector in accordance with the present invention, the contact portion protruded from the internal casing and electrically connected to the external casing can eliminate electrostatic charges in the connector effectively, and thus the present invention definitely can overcome the shortcomings of the prior art.

While the invention has been described by way of examples and in terms of preferred embodiments, it is to be understood that the invention is not limited thereto. To the contrary, it is intended to cover various modifications and similar arrangements and procedures, and the scope of the appended claims therefore should be accorded the broadest interpretation so as to encompass all such modifications and similar arrangements and procedures.

In summation of the description above, the present invention complies with the patent application requirements and is submitted to the Patent and Trademark Office for review and granting of the commensurate patent rights.

What is claimed is:

1. A connector, comprising:

an insulating base body, having a base portion, and said base portion further including a plurality of layers of containing spaces disposed at a front end of said base portion;

an external casing, installed on an external side of said insulating base body;

a first connector, contained in said containing space and including a plurality of first terminals and a first internal casing; and at least one second connector, contained in said containing space and including a plurality of second terminals and a second internal casing, and said second internal casing further including a contact portion protruded separately from both sidewalls of said second connector for electrically connecting said external casing;

thereby, said contact portion on said second internal casing is electrically connected with said external casing for eliminating electrostatic charges, wherein said external casing further includes a front casing and a rear casing, and said front casing includes a plurality of openings thereon, and said rear casing includes a plurality of grounding pins disposed at the bottom of said rear casing and a plurality of protrusions disposed on the lateral sides of said rear casing for eliminating electrostatic charges from said casing through said grounding pins, wherein the front and rear casings are configured to be selectively separated into two separate parts.

2. The connector of claim 1, wherein said contact portion is an outwardly protruded bracket.

3. The connector of claim 1, wherein said insulating base body is an integral structure.

4. The connector of claim 1, wherein said containing space includes at least two layers, and the first layer is a USB interface, and the second layer is a SATA interface, and said second containing space is situated under said first containing space.

5. The connector of claim 1, wherein said first connector is a USB connector and said second connector is a SATA connector.

6. The connector of claim 1, further comprising a partition disposed between said containing spaces.

7. The connector of claim 1, wherein said contact portion is an outwardly protruded bracket.

8. The connector of claim 1, wherein said insulating base body further comprises a first containing space and a second containing space, and said each containing space includes a tongue portion, wherein said first containing space is provided for containing said first connector, and said second containing space is provided for containing said second connector.

9. The connector of claim 8, wherein said tongue portion further comprises a terminal containing groove, and a base portion of said tongue portion includes a fixing hole.

10. The connector of claim 1, wherein said containing space includes at least two layers, and the first layer is a USB interface, and the second layer is a SATA interface, and said second containing space is situated on the top of said first containing space.

11. The connector of claim 10, wherein said insulating base body further includes a fixing portion disposed at the rear end of said insulating base body for fixing a USB terminal.

12. The connector of claim 10, wherein said connector further includes a rear base for fixing a SATA terminal.

13. The connector of claim 8, wherein said first internal casing is installed on an external side of said first containing space, and its opening is substantially in a flared shape, and said second internal casing is installed on an external side of said second containing space.

14. The connector of claim 13, wherein said first internal casing includes a first bracket separately disposed at the top and the bottom of said first internal casing for securely connecting a USB connector to said first connector, and said first internal casing further includes a first fixing plate disposed at an internal side of said first internal casing for fixing said fixing hole on said insulating base body.

15. The connector of claim 13, wherein said second internal casing includes a second bracket separately disposed at the top and the bottom of said second internal casing for securely connecting a SATA connector to said second connector, and said second internal casing further includes a second fixing plate disposed at an internal side of said second internal casing for fixing said fixing hole on said insulating base body.

16. The connector of claim 1, further comprising a rear base for fixing said second terminal, and said rear base including a plurality of holes for fixing said second terminal therein.

17. The connector of claim 16, wherein said rear base is fixed between two sidewalls of said base portion of said insulating base body.

* * * * *